US005458534A

United States Patent [19]

Campione et al.

[11] Patent Number: 5,458,534

[45] Date of Patent: Oct. 17, 1995

[54] KNIFE SHARPENING DEVICE WITH ANGLED GUIDE PLATES

[76] Inventors: Antonino Campione, 500 Bauman Rd., Williamsville, N.Y. 14221; William M. Handel, 94 Philip Dr., Amherst, N.Y. 14228

[21] Appl. No.: 296,499

[22] Filed: Aug. 26, 1994

[51] Int. Cl.[6] ..... B23F 21/03

[52] U.S. Cl. ..... 451/555; 451/540; 451/552; 451/558

[58] Field of Search ..... 451/552, 555, 451/556, 557, 558, 540, 344, 545, 549, 45

[56] References Cited

U.S. PATENT DOCUMENTS

| | | | |
|---|---|---|---|
| 534,770 | 2/1895 | Sweet, Jr. | 451/555 |
| 819,735 | 5/1906 | Cruce | 451/552 |
| 1,172,569 | 2/1916 | Sheafor | 451/557 |
| 2,559,273 | 7/1951 | Brinkley | 451/555 |
| 2,645,066 | 7/1953 | Andrews | 451/555 |

*Primary Examiner*—Bruce M. Kisliuk
*Assistant Examiner*—Eileen P. Morgan
*Attorney, Agent, or Firm*—James J. Ralabate

[57] ABSTRACT

A sharpener which has a main body portion to hold and support a sharpening stone 1. The main body is connected at one of its ends to a front guide plate and on the opposite end to a back guide plate. These two plates, in addition to guiding the direction of a knife blade during sharpening, also act to hold the stone in position. The back guide plate also acts as a finger guard and as a handle means for the sharpener.

16 Claims, 2 Drawing Sheets

Fig. 1
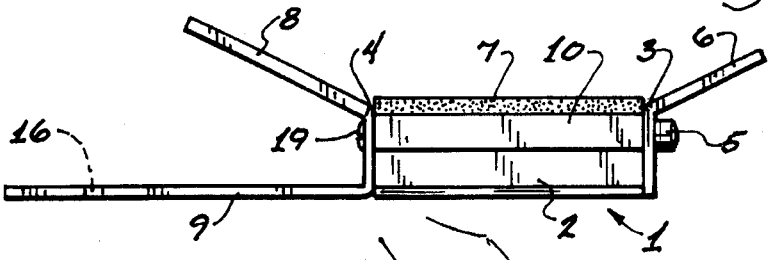
Fig. 2
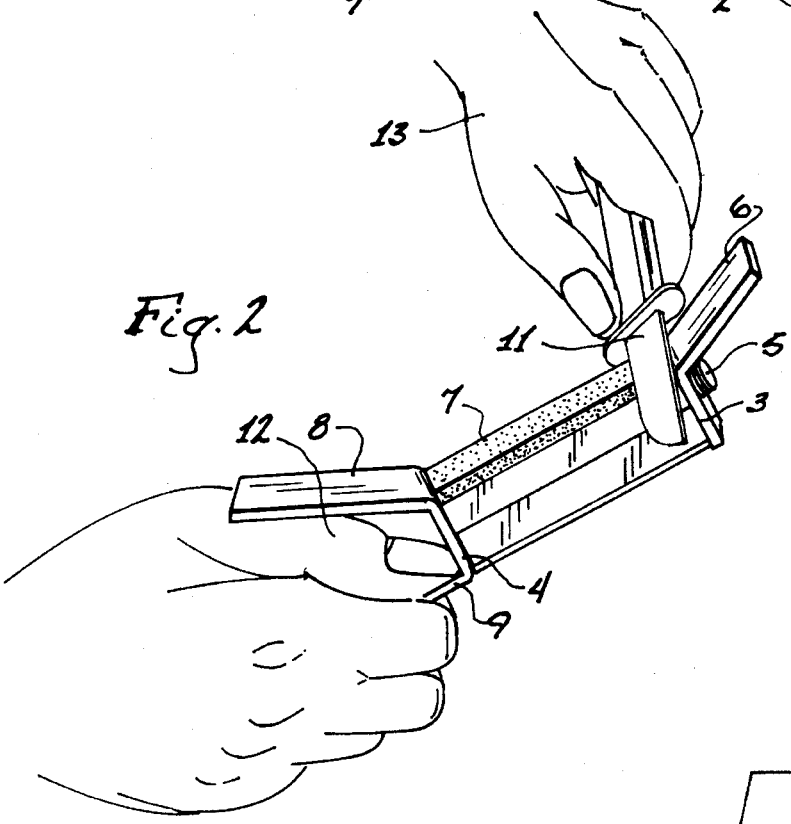
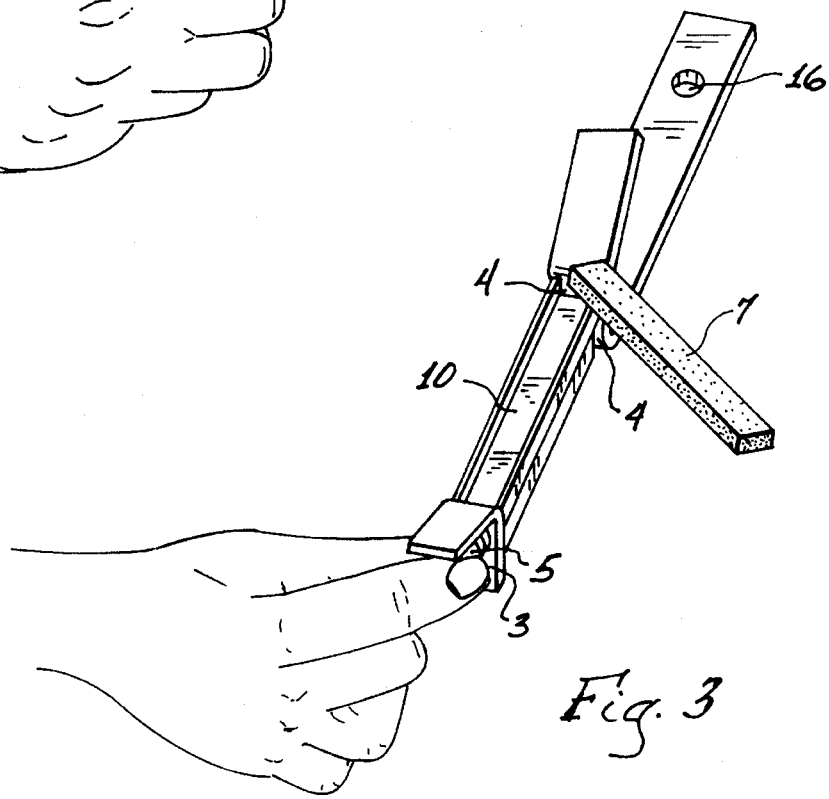
Fig. 3

KNIFE SHARPENING DEVICE WITH ANGLED GUIDE PLATES

SHARPENING DEVICE

This invention relates to a sharpening device and, more particularly, to a portable device usable for sharpening knives, scissors, pruning shears, chain saws, arrow heads, darts, fish hooks, and the like.

BACKGROUND OF THE INVENTION

There are known several mechanisms for sharpening knives and the like; some are portable, some are stationary. In the portable structures one problem that has been encountered is that the hone stone will eventually wear at given locations and must be discarded. Most prior art sharpeners provide a honing stone that is permanently attached to the sharpener. Thus, when the stone becomes worn and expended, the entire device becomes worn and expended and therefore is disposed of. An additional problem with prior art portable sharpeners is that the fingers of the user are exposed to the knife during the sharpening or honing operation. Other devices do not provide adequate guides for the knife blade. Thus, uneven and inconsistent sharpening usually occurs. Several sharpeners comprise an elongated sharpening rod extending out from a handle. The knife to be sharpened is then manipulated up and down the sharpening rod in random strokes or movements until the desired edge sharpening occurs. This type of honing is imprecise and does not result in controlled sharpening. While use of this rod type device can result in sharpening, the fingers of the user are exposed, uneven sharpening can occur and wear on the abrasive rod eventually means discarding the entire device.

Typical known other sharpening devices are disclosed in U.S. Pat. Nos. 3,871,141; 4,197,677; 4,291,506 and 4,991,357. In U.S. Pat. No. 3,871,141 (Bonapace) a knife sharpener is disclosed having a flexible band of a fine grain abrasive surface, a frame for mounting the band in a generally V shape and a compression spring within the frame for maintaining the band under tension while permitting the band to yield when a knife is applied thereto. The band is flexible to permit the angle and lateral position of the sides thereof to conform to the angle and force at which the knife is applied thereto. In this type device the sharpening is not guided at all thus allowing the angle of sharpening to be as inconsistent as the inconsistency of the user's strokes against the flexible band. Also, the size of this type sharpener makes it inconvenient to carry such as on camping trips, etc.

In U.S. Pat No. 4,197,677 (Graves) another type sharpener is disclosed having a cylindrical sharpening rod to which a pair of conical guide members have been fixed on either end. A handle extends out from one of the guide members for proper support during the honing operation. The rod is constructed of a ceramic material containing strong abrasives. One hand of the user grips the handle so that the other hand can be used to draw the blade simultaneously along the rod and along the blade from near the blade handle toward the blade tip. No precise guides are provided in this type sharpener only the blade is positioned flat against the conical surface of a guide and that angle is attempted to be manually maintained during each succeeding sharpening stroke. Effectiveness of the sharpening will vary from operator to operator and could not effectively be used by an apprentice who may sharpen at angles other than the proper one. This type device, because of its shape and size, is also cumbersome to carry during hunting, fishing and other type recreational trips.

In U.S. Pat. No. 4,291,506 (Kramm) a hone stone is described having the stone mounted into an expandable stone receiving assembly. The assembly comprises a relatively rigid body having end regions that are convex cylindrical surfaces. A cavity defined by these surfaces receives the stone so that a working face of the stone is exposed. Slots are defined in each end region which extend in the direction of the stone which define a pair of resilient bifurcated portions in each end region to provide also a firm frictional engagement between the hone stone assembly and the honing head. Guide portions to control the sharpening angle are not provided in this type sharpener to maintain a consistent sharpening angle and generally uniform results. Also, no hand protection is provided in Kramm's device.

Some knife sharpeners do provide for removable stones such as in U.S. Pat. No. 4,991,357 (Stickles). In Stickles a case defining a hollow trough is provided where the width of the bottom portion of the trough is slightly less than the width of a stone that can be removably seated therein. Blade support surfaces that are angled upwardly and outwardly surround the seated stone whereby a knife blade is held flatwise against either blade support surface. Protection for the fingers of the user would enhance the type of sharpener disclosed by Stickles.

Thus, a permanent, portable sharpener having interchangeable or removable stones with appropriate guides and hand guards and that is relatively inexpensive would be a significant improvement over the known prior art.

SUMMARY OF THE INVENTION

Therefore it is an object of this invention to provide a knife sharpener devoid of the above-noted disadvantages.

Another object of this invention is to provide a sharpener having an easily removable stone thus varying the location of wear areas of the stone.

A still further object of this invention is to provide an easily disassembled sharpener that can be dismantled to carry, to pack or just to reduce in size for whatever reason.

A yet further object of this invention is to provide a permanent sharpener with a consumable stone in order to allow continued use of the sharpener after the stone is worn and replaced.

Another further object of this invention is to provide a compact sharpener having externally stone removable means with knife guides and comfortable hand protection means.

A still yet further object of this invention is to provide a sharpener that is compatible and usable with similar competitive devices.

Another yet further object of this invention is to provide a sharpener that is easy to assemble and disassemble, effective to use, can be easily mounted and provides an angle guide for uniform and consistent results.

These and other objects of this invention are accomplished generally speaking by a five component sharpener comprising a main housing or stone holder, a removable hand guard that also acts as a rear element blade guide, a removable front blade guide or plate, an adjustable tightening and loosening means and a removable sharpening stone. The main housing or stone holder comprises a substantially rectangular structure having an upper compartment which extends throughout the length of the main housing. This upper compartment provides the support into which the sharpening stone fits and is removably positioned. The compartment is just deep enough so that a portion of the stone projects upwardly therefrom to be available for contact with a knife blade. There are two extending side portions in this compartment extending the length of the compartment and each terminal end section of this compartment is open. The stone is slid into the elongated compartment and each of the open terminal ends closed off by connecting thereto the front and rear blade guide elements. These abutting front and rear blade guide elements lock the stone into the compartment and firmly hold it in place. When a part of the stone becomes worn, only one of the blade guide elements is removed. The stone is removed from the compartment and turned so that an unworn stone section is now available as the exposed sharpening locus. In other words, the stone if worn on the top surface, may be turned so that the original bottom surface is now on top and exposed. If the front section of the stone is worn it can be reversed so that the unused back section now becomes the front section, etc. The main housing or stone holder has threaded apertures on each of its terminal ends which are used to connect each of the guide plates thereto. The front guide plate is attached to the front of the main housing by a turn screw that is easily finger tightened or removed without the need for tools. The back angle guide element can be more permanently attached by a screw or other means, if desirable. The back angle guide element acts as the rear stop and holding means for the stone while the front guide plate acts as the means for applying pressure to hold the front portion of the stone in place. In another embodiment, the front guide plate and/or rear guide elements can have apertures through which the stone can fit rather than abut. Any other suitable means can be used to hold the stone in place. The stone can be square thereby giving the user 4 sides to use up when one becomes worn. The front guide plate is somewhat L-shaped and has a lower leg that is an aperture for receiving the turn screw for attachment to the main housing. The upper leg or segment of the front guide plate is angled upwardly from horizontal at an angle of from about 15–30 degrees. This upper leg serves as the proper guide for the knife blade during the sharpening procedure. A corresponding angle is provided in an upper segment or leg of the back angle guide so that the angle of contact with the stone remains consistent. It is critical to this invention that these angles be substantially equal so that the same front and rear sharpening angle is maintained. The back angle guide has a somewhat U-shaped configuration with the upper leg acting both as a blade guide and as a finger or thumb guard. The lower leg of the back angle guide provides the handle means by which the sharpening device is grasped during use. The device of this invention is preferably made from aluminum but can be made of any suitable material such as metal other than aluminum, plastic, fiberglass or any other material. The size of the entire sharpening unit can vary since it can be disassembled easily into small components. It is preferred, however, that the stone holder or main housing have a standardized compartment to hold standard sized sharpening stones, i.e. 4"×½"×¼". The stones used can be with or without oil impregnation and can be of any known style or composition such as aluminum oxide, silicon carbide, diamond, other materials or mixtures thereof. Natural stone, also known as Washita stones, India stones, whetstones and other substantially non-toxic stones can be used especially to sharpen dental instruments and the like. Since the stone is easily removable in the present invention, it is no longer required to dispose of the entire sharpener after the stone is worn. The light-weight and compact size of the sharpener make it convenient to fit into a pocket, sheath or other areas commonly used for carrying similar items. The guide-handle adds safety to the efficiency of this device since blade exposure to fingers and the thumb are substantially reduced. If desired, either or both front and rear guide elements can be replaced with other angled elements if desirable for any use. Also, the handle portion of the rear guide element has at least one aperture for use in connecting the sharpener to a supporting structure such as a table, wall, meat-cutting block, boat gunnel and the like. The handle of the sharpener of this invention has means to affix the sharpener to a table without need for additional attachments such as mounts or clamps. Also, it is much simpler than prior art devices to connect the present sharpener to a base structure. Since the stone is removable in the present structure, there is no need to use highly toxic adhesives or glues to connect the stone to the stone holder. Thus, the device of this invention can be recycled without any resulting toxicity. It can easily be sanitized for dental or other uses. Oil impregnated stones may be used in the device of this invention although any type standard stone may be used as noted above. Also, as earlier noted, the sharpener of the present invention can be used with substantially all other guide angle sharpening systems of major or popular sharpeners. The sharpener of the present invention can be used in an upright position or can be used in an inverted position depending on user preference. The two opposing 15–30 degree inclined guide plates permit the user to sharpen both sides of the knife in one step without changing position. This is a critical feature of the present invention. If suitable, the stone holder can be fastened to the stone by a fastener means or by magnetic attraction. The handle portion or other components may also be magnetized for connection to a base structure. Also, the sharpening device can have connection means on any part of its structure for connection to a base or other supports. This device can also be used alone or with attachable features for other sharpening uses, ie. chain saws, ice skates, ice picks, lawn mowers, dental instruments, etc.

BRIEF DESCRIPTION OF THE DRAWINGS

FIG. 1 is a side plan view of the assembled sharpener of this invention with the stone in place.

FIG. 2 is a perspective view showing the use of the present sharpener in the knife-sharpening process.

FIG. 3 is a perspective view showing the removal and/or replacing of a sharpening stone in the device of the present invention.

DETAILED DESCRIPTION OF THE DRAWINGS AND PREFERRED EMBODIMENTS

Figure 4:
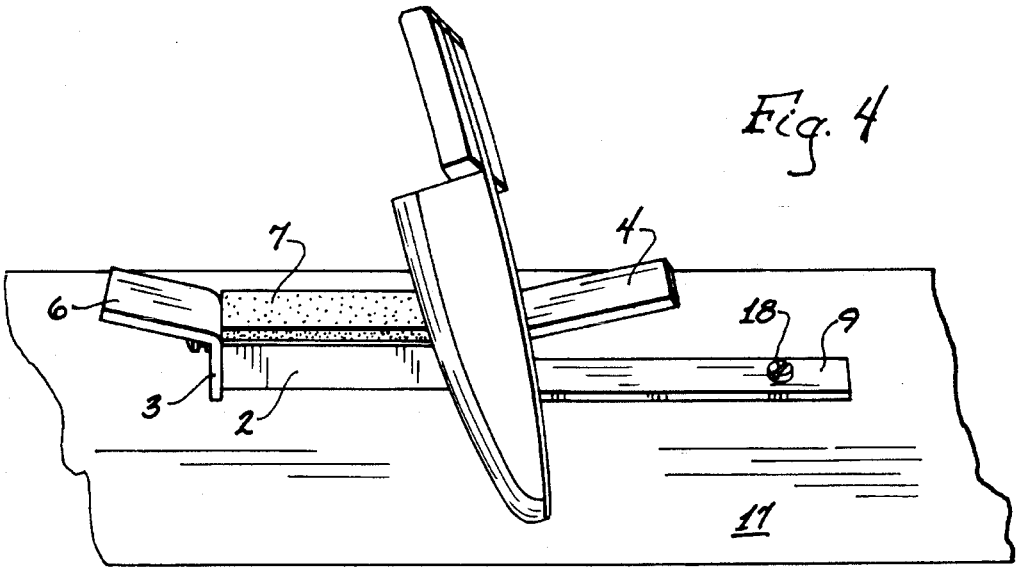
FIG. 4 is a perspective view showing the use of the device of this invention when mounted on a support such as a table.
Figure 5:
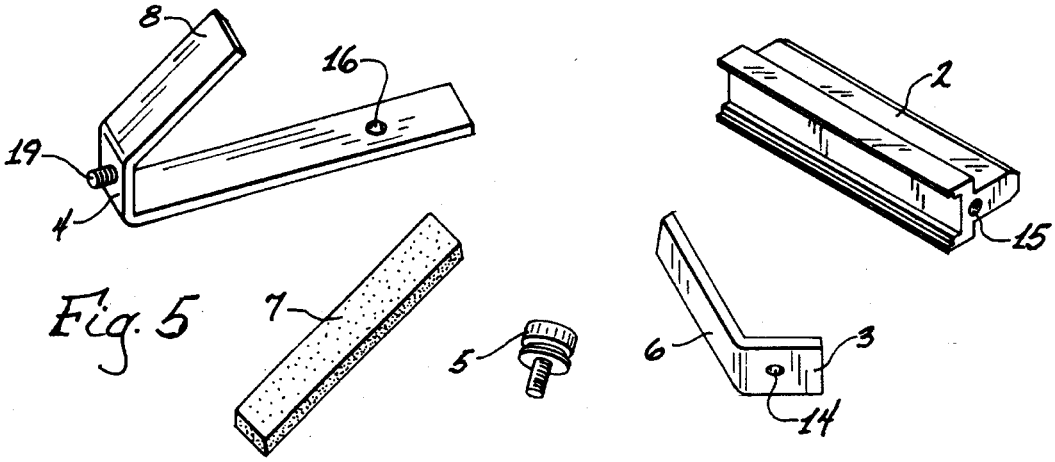
FIG. 5 is a view of the device of this invention disassembled and broken down into component parts.
Figure 6:
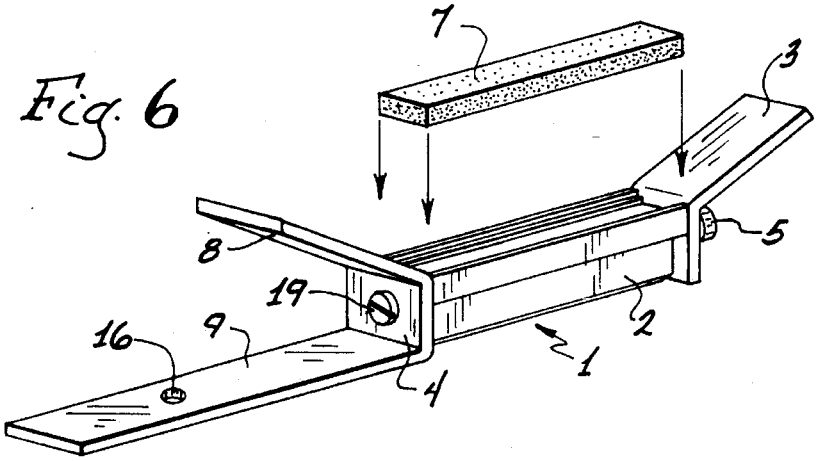
FIG. 6 is a side perspective view of the sharpener of this invention assembled except for the sharpening stone being in place.

In FIG. 1 the knife sharpener 1 of this invention is shown in a side plan view. The stone holder or supporting component 2 is generally rectangular in configuration and has connected on one end a modified L-shaped front guide plate 3 and on the opposite end a modified U-shaped hand guard-angle back guide plate or element 4. The front guide plate 3 is removably attached to stone holder 2 by a turn screw 5 which is easily removed without the need for tools of any nature. The upper leg 6 of front guide plate 3 extends upward and outward from the stone holder 2 at an angle of about 15–30 degrees from a horizontal axis of holder 2. This provides the proper angle for a blade to be sharpened during contact with stone 7. Conversely, back guide plate 4 which extends outwardly from holder 2 at approximately the same angle as front guide plate 3 provides this same angle for a knife (or other item) blade during the backstroke of a sharpening operation. The upper leg 8 of back plate 4 acts as a finger or thumb guide and the lower leg 9 of back plate 4 acts as a handle which is generally held by the left hand during the sharpening operation. In addition, both upper legs 6 and 8 act as angle guides for the blade during the sharpening operation. To insert stone 7 into the channel or stone compartment 10 (see FIG. 6), the user merely turns or loosens screw 5, removes guide 3, slides stone 7 into channel 10 so that its front portion 11 contacts back plate 4 and then replaces guide 3 by tightening screw 5 thereby holding stone 7 in position because of the holding pressure of guides 3 and 4. Stone 7 extends above the top section of stone holder 2 so that it is exposed sufficiently for a blade to contact it properly during sharpening. In FIG. 2 the sharpener 1 is shown during the sharpening operation as knife blade 11 contacts stone 7 at an angle imposed by front guide plate 3. Note that guide plate 3 imposes a set sharpening angle on one side of the blade and back guide plate 4 imposes a set angle on the opposite side of the blade 11. The thumb 12 fits under the protection of the hand guard or upper leg 8 of back guide plate 4 as shown in FIG. 2. Handle or lower leg 9 of back guide plate 4 is firmly grasped in one hand while the other hand 13 is free to hold the knife being sharpened. In figure 3 the placing of stone or removal of stone 7 is shown. Turn screw 5 is loosened so that front guide plate 3 is loosened sufficiently to permit room for stone 7 to be placed into stone channel or compartment 10. After stone 7 is in place, front guide plate 3 which is put in place against the aperture 16 in back guide plate is shown. Aperture 16 is used to connect sharpener 1 to a support 17 such as a table or bench as shown in FIG. 4. A screw 18 or other connecting means is inserted into aperture 16 to attach sharpener 1 to a base support if desired. In FIG. 4 the sharpener 1 is easily attached to a support that is either horizontal or vertical. If desired, more than one aperture 16 can be used in handle portion 9 of back guide plate 4. The angle of the sharpening is determined by blade 11 resting against guide 3 or guide 4 as shown in FIG. 4. FIG. 5 shows sharpener 1 disassembled into its component parts, i.e. stone holder 2, front guide plate 3, back guide plate 4, turn screw 5 and stone 7. A removable screw 19 is used to connect back guide plate 4 to stone holder 2. In FIG. 6 a perspective side view of the sharpener 1 of this invention is shown. The sharpener 1 is assembled except for insertion of stone 7 into channel or compartment 10. When fully assembled, stone 7 is fit loosely into compartment 10 and either or both screws 5 and 19 are tightened so that plates 3 and 4 abut against stone 7 after placement to hold tightly in place. Any type suitable stone 7 may be used as earlier noted. Turn screw 5 may be used on or as the connecting means with either or both plate 3 and plate 4. Illustrated in all the figures is use of screw 5 only on plate 3 but it should be understood that it may be used in back plate 4 or in both back plate 4 and front plate 3.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A knife sharpener comprising in combination a stone, a stone holder, a removable back guide plate, a removable front guide plate, and stone removal means, said stone being substantially rectangular and having front and rear terminal portions, said stone removal means comprising an externally adjustable means attachable with said front guide plate, said front guide plate together with said removable back guide plate holding said stone in position by contact with the front and rear terminal portions respectively of said stone, said stone removable from said sharpener by loosening said externally adjustable means thereby relaxing and releasing said contact between said stone and said front guide plate and said removable back guide plate, and wherein said front and back guide plates extend outwardly away from said stone holder and upwardly at about 15–30 degrees from a horizontal axis of said stone holder.

2. The knife sharpener of claim 1 wherein said front guide plate has a modified L-shape configuration.

3. The knife sharpener of claim 1 wherein said back guide plate has a modified U-shape configuration.

4. The knife sharpener of claim 1 wherein said back guide plate has an upper leg portion that provides a guard to the fingers or thumb of the user.

5. The knife sharpener of claim 1 wherein said back guide plate has a lower leg portion that provides a handle and mounting means for said sharpener.

6. The knife sharpener of claim 1 wherein said back guide plate provides means for blade guiding, means for guarding and handle means for said sharpener.

7. The knife sharpener of claim 1 wherein said front guide plate provides means for blade guiding during a sharpening operation.

8. A knife sharpener comprising in combination a stone holder, a stone, a removable back guide plate, a removable front guide plate and stone removal means, said stone holder having a substantially rectangular configuration and having at an upper portion an open compartment for receiving and holding said stone, said compartment extending substantially the length of said stone holder, said front guide plate and said back guide plate abutting and movably connected to said stone holder, said front guide plate and said back guide plate when abutting said stone holder providing means for holding said stone tightly in said compartment, said stone removable from said sharpener by loosening said front or back plate from its connection to said stone holder and wherein said front and back guide plates extend outwardly away from said stone holder and upwardly at about 15–30 degrees from a horizontal axis of said stone holder.

9. The knife sharpener of claim 8 wherein said front guide plate has a modified L-shape configuration.

10. The knife sharpener of claim 8 wherein said back guide plate has a modified u-shape configuration.

11. The knife sharpener of claim 8 wherein said back guide plate has an upper leg portion that provides a guard to the fingers or thumb of the user.

12. The knife sharpener of claim 8 wherein said back guide plate has a lower leg portion that provides a handle means for said sharpener.

13. The knife sharpener of claim 8 wherein said back guide plate provides means for blade guiding, means for guarding and handle means for said sharpener.

14. The knife sharpener of claim 8 wherein said front guide plate provides means for blade guiding during a sharpening operation.

15. The knife sharpener of claim 8 wherein said guide plates have apertures through which the stone is held under pressure.

16. The knife sharpener of claim 8 wherein said guide plates abut said stone to hold said stone in position.

* * * * *